US010360884B2

(12) United States Patent
Okuda et al.

(10) Patent No.: US 10,360,884 B2
(45) Date of Patent: Jul. 23, 2019

(54) ELECTRONIC WIND INSTRUMENT, METHOD OF CONTROLLING ELECTRONIC WIND INSTRUMENT, AND STORAGE MEDIUM STORING PROGRAM FOR ELECTRONIC WIND INSTRUMENT

(71) Applicant: CASIO COMPUTER CO., LTD., Tokyo (JP)

(72) Inventors: Hiroko Okuda, Tokyo (JP); Ryutaro Hayashi, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/919,899

(22) Filed: Mar. 13, 2018

(65) Prior Publication Data

US 2018/0268791 A1 Sep. 20, 2018

(30) Foreign Application Priority Data

Mar. 15, 2017 (JP) ..... 2017-049331
Mar. 15, 2017 (JP) ..... 2017-050057
(Continued)

(51) Int. Cl.
*G10H 1/00* (2006.01)
*G10H 3/00* (2006.01)
(Continued)

(52) U.S. Cl.
CPC ..... *G10H 1/0008* (2013.01); *G10H 1/0066* (2013.01); *G10H 1/053* (2013.01);
(Continued)

(58) Field of Classification Search
CPC ..... G10H 2220/361; G10H 1/348; G10H 2220/525; G10H 2230/221;
(Continued)

(56) References Cited

U.S. PATENT DOCUMENTS 5,125,315 A * 6/1992 Kawashima ..... G10H 1/20 84/619
5,929,361 A * 7/1999 Tanaka ..... G09B 15/003 84/380 R
(Continued)

FOREIGN PATENT DOCUMENTS

JP 2008-152297 A 7/2008

*Primary Examiner* — Marlon T Fletcher
(74) *Attorney, Agent, or Firm* — Chen Yoshimura LLP

(57) ABSTRACT

An electronic wind instrument according to one aspect of the present invention includes a plurality of performance keys for specifying pitches, a breath sensor which detects at least a breath input operation, and a controller (CPU), wherein the controller (CPU) selectively switches between a first mode of outputting first sound waveform data generated on the basis of the breath input operation and operation of at least one performance key from among the plurality of performance keys, and a second mode of, when the breath input operation is detected, outputting second sound waveform data based on musical piece data regardless of whether operation of the at least one performance key is detected or is not detected.

12 Claims, 9 Drawing Sheets

(30) Foreign Application Priority Data

Mar. 15, 2017 (JP) ..... 2017-050121
Sep. 27, 2017 (JP) ..... 2017-186499

(51) Int. Cl.
*G10H 1/34* (2006.01)
*G10H 1/053* (2006.01)
*G10H 1/055* (2006.01)

(52) U.S. Cl.
CPC ..... *G10H 1/0551* (2013.01); *G10H 1/344* (2013.01); *G10H 2210/221* (2013.01); *G10H 2220/361* (2013.01); *G10H 2250/461* (2013.01)

(58) Field of Classification Search
CPC .. G10H 2250/461; G10H 1/32; G10H 1/0016; G10H 2230/205; G10H 2240/131; G10H 2240/135; G10H 2210/091; G10H 2210/101; G10H 1/183; G10H 2240/125; G10H 2250/631
See application file for complete search history.

(56) References Cited

U.S. PATENT DOCUMENTS 6,002,080 A * 12/1999 Tanaka ..... G10D 7/00 84/609
2005/0056139 A1* 3/2005 Sakurada ..... G10H 5/005 84/616
2005/0076774 A1* 4/2005 Sakurada ..... G10H 1/0016 84/616
2007/0017346 A1* 1/2007 Masuda ..... G10H 1/053 84/600
2007/0017352 A1* 1/2007 Masuda ..... G10H 1/053 84/658
2007/0068372 A1* 3/2007 Masuda ..... G10H 1/0008 84/723
2007/0137468 A1* 6/2007 Shibata ..... G10H 1/348 84/723
2009/0019999 A1* 1/2009 Onozawa ..... G10H 1/34 84/658
2009/0020000 A1* 1/2009 Onozawa ..... G10D 7/00 84/723
2015/0348525 A1* 12/2015 Nakae ..... G10H 1/0008 84/735
2016/0275930 A1* 9/2016 Harada ..... G10H 1/46
2018/0075831 A1* 3/2018 Toyama ..... G10H 1/0551
2018/0268791 A1* 9/2018 Okuda ..... G10H 1/0008

* cited by examiner

ELECTRONIC WIND INSTRUMENT, METHOD OF CONTROLLING ELECTRONIC WIND INSTRUMENT, AND STORAGE MEDIUM STORING PROGRAM FOR ELECTRONIC WIND INSTRUMENT

BACKGROUND OF THE INVENTION

Technical Field

The present invention relates to an electronic wind instrument, a method of controlling the electronic wind instrument, and a storage medium storing a program for the electronic wind instrument.

Background Art

One example of a conventionally well-known musical instrument includes an oral input unit for inputting a signal emitted from the mouth of a performer, a storage unit which stores first performance data representing an accompaniment sound suitable for a melody sound, a level detector which detects a level of the signal input from the oral input unit and outputs a trigger signal when the detected level is greater than or equal to a prescribed level, a read processor which reads the first performance data from the storage unit on the basis of the trigger signal output from the level detector, and a first musical note generator which generates the accompaniment sound on the basis of the first performance data read by the read processor (see Patent Document 1).

Furthermore, Patent Document 1 describes that this type of musical instrument makes it possible to play an accompaniment sound suitable for a melody sound and, as long as a signal of greater than or equal to the prescribed level is input to the oral input unit, also makes it possible to continue the performance without stopping even if the pitch information produced by the mouth is incorrect. This, in turn, makes it possible even for a beginner to continue practicing without losing interest in or getting tired of practicing, and avoiding stoppage of the performance is advantageous for when practicing a performance together with other performers.

Patent Document 1: Japanese Patent Application Laid-Open Publication No. 2008-152297

Although wind instruments are played through a combination of the performer's breathing and operation of performance keys, when a beginner is practicing, it is preferable that it be possible to practice by focusing on practicing just the breathing, for example, and there is still room for improvement in practice modes for electronic wind instruments.

Moreover, being able to separately practice these types of unique breathing techniques for wind instruments in a focused manner makes it possible to efficiently improve performance ability.

SUMMARY OF THE INVENTION

Accordingly, the present invention is directed to a scheme that substantially obviates one or more of the problems due to limitations and disadvantages of the related art. One advantage of the present invention lies in making it possible to satisfactorily improve performance ability.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides an electronic wind instrument, including: a plurality of performance keys for respectively specifying pitches; a breath sensor that detects a breath input operation by a user; a memory storing therein musical piece data of a musical piece, the musical piece data including a part to be played by the electronic wind instrument; and a processor, wherein the processor defines user-selectable at least two modes of operation, which are a normal mode and a practice mode, wherein in the normal mode, the processor generates sound waveform data in accordance with both of the breath input operation and operations of the plurality of performance keys by the user, and causes the generated sound waveform date to output audibly to the user, and wherein in the practice mode, the processor performs the following: receiving instructions from the user to select the musical piece to be practiced; reading out at least a portion of the musical piece data representing at least a pitch of a note to be played by the electronic wind instrument in the selected musical piece from the memory; generating sound waveform data, even if there is no operation of the performance keys by the user, in accordance with the breath input operation by the user and the read out portion of the musical piece data representing at least the pitch of the note; and causing the generated sound waveform data to output audibly to the user so that the user can practice the breath input operation for the musical piece even if there is no operation of the performance keys by the user.

In another aspect, the present disclosure provides a method performed by a processor in a practice mode of an electronic wind instrument that includes a plurality of performance keys for respectively specifying pitches; a breath sensor that detects a breath input operation by a user; a memory storing therein musical piece data of a musical piece, the musical piece data including a part to be played by the electronic wind instrument; and the processor, wherein the processor defines user-selectable at least two modes of operation, which are a normal mode and the practice mode, wherein in the normal mode, the processor generates sound waveform data in accordance with both of the breath input operation and operations of the plurality of performance keys by the user, and causes the generated sound waveform date to output audibly to the user, and wherein in the practice mode, the method performed by the processor includes: receiving instructions from the user to select the musical piece to be practiced; reading out at least a portion of the musical piece data representing at least a pitch of a note to be played by the electronic wind instrument in the selected musical piece from the memory; generating sound waveform data, even if there is no operation of the performance keys by the user, in accordance with the breath input operation by the user and the read out portion of the musical piece data representing at least the pitch of the note; and causing the generated sound waveform data to output audibly to the user so that the user can practice the breath input operation for the musical piece even if there is no operation of the performance keys by the user.

In another aspect, the present disclosure provides a non-transitory computer-readable storage medium having stored thereon a program executable by a processor in a practice mode of an electronic wind instrument that includes a plurality of performance keys for respectively specifying pitches; a breath sensor that detects a breath input operation by a user; a memory storing therein musical piece data of a musical piece, the musical piece data including a part to be played by the electronic wind instrument; and the processor, wherein the program causes the processor to define user-selectable at least two modes of operation, which are a normal mode and the practice mode, wherein in the normal mode, the program causes the processor to generate sound waveform data in accordance with both of the breath input operation and operations of the plurality of performance keys by the user, and cause the generated sound waveform date to output audibly to the user, and wherein in the practice mode, the program causes the processor to perform the following: receiving instructions from the user to select the musical piece to be practiced; reading out at least a portion of the musical piece data representing at least a pitch of a note to be played by the electronic wind instrument in the selected musical piece from the memory; generating sound waveform data, even if there is no operation of the performance keys by the user, in accordance with the breath input operation by the user and the read out portion of the musical piece data representing at least the pitch of the note; and causing the generated sound waveform data to output audibly to the user so that the user can practice the breath input operation for the musical piece even if there is no operation of the performance keys by the user.

In another aspect, the present disclosure provides an electronic wind instrument, including: a plurality of performance keys for respectively specifying pitches; a breath sensor that detects a breath input operation by a user; a memory storing therein musical piece data of a musical piece, the musical piece data including a part to be played by the electronic wind instrument; and a processor, wherein the processor defines user-selectable at least two modes of operation, which are a normal mode and a practice mode, wherein in the normal mode, the processor generates sound waveform data in accordance with both of the breath input operation and operations of the plurality of performance keys by the user, and causes the generated sound waveform date to output audibly to the user, and wherein in the practice mode, the processor performs the following: receiving instructions from the user to select the musical piece to be practiced; reading out at least a portion of the musical piece data representing at least a breath value to be played by the electronic wind instrument in the selected musical piece from the memory; generating sound waveform data, even if there is no breath input operation by the user, in accordance with the operation of the performance keys by the user and the read out portion of the musical piece data representing at least the breath value; and causing the generated sound waveform data to output audibly to the user so that the user can practice the operation of the performance keys for the musical piece even if there is no breath input operation by the user.

It is to be understood that both the foregoing general description and the following detailed description are exemplary and explanatory, and are intended to provide further explanation of the invention as claimed.

BRIEF DESCRIPTION OF THE DRAWINGS

The present application can be deeper understood by considering the following detailed description together with the accompanying drawings.

FIG. 1A is a front view of the electronic wind instrument and FIG. 1B is a side view of the electronic wind instrument.

DETAILED DESCRIPTION OF EMBODIMENTS

Next, an embodiment of the present invention will be described with reference to the attached drawings.

Figure 1A:
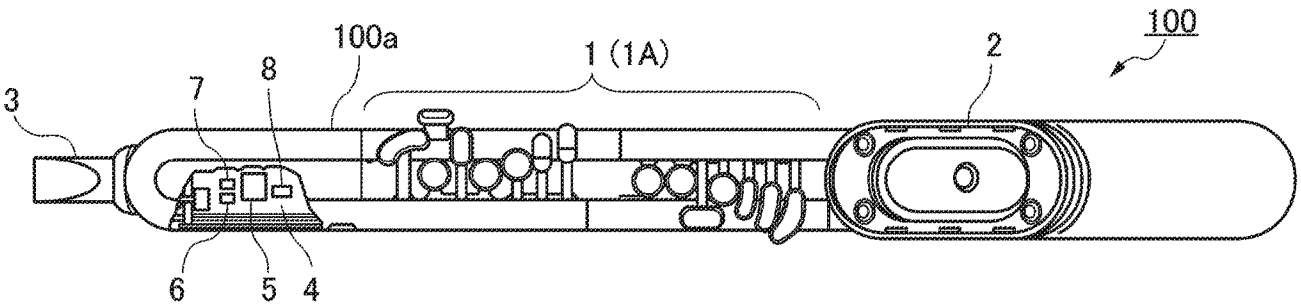
FIGS. 1A and 1B illustrate an electronic wind instrument according to an embodiment of the present invention, where
Figure 1B:
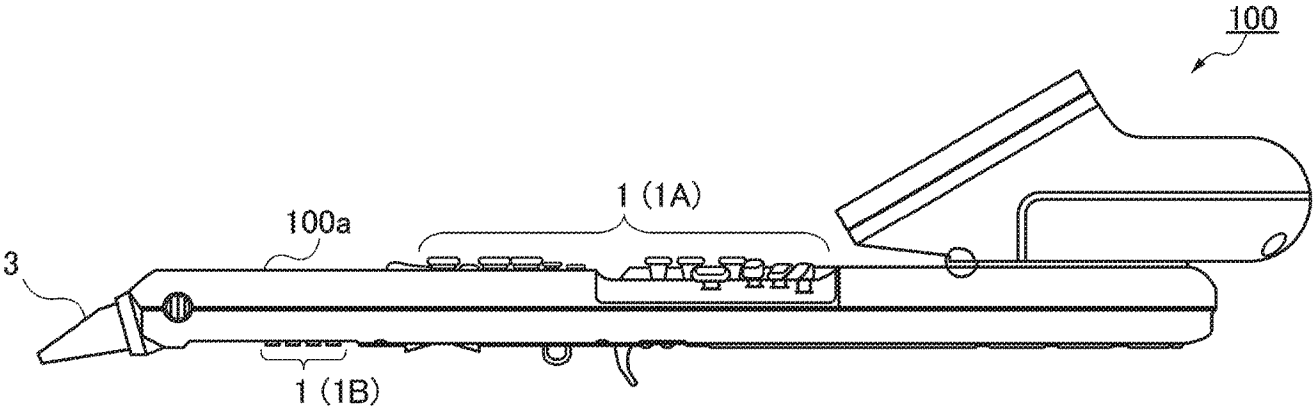
Figure 2:
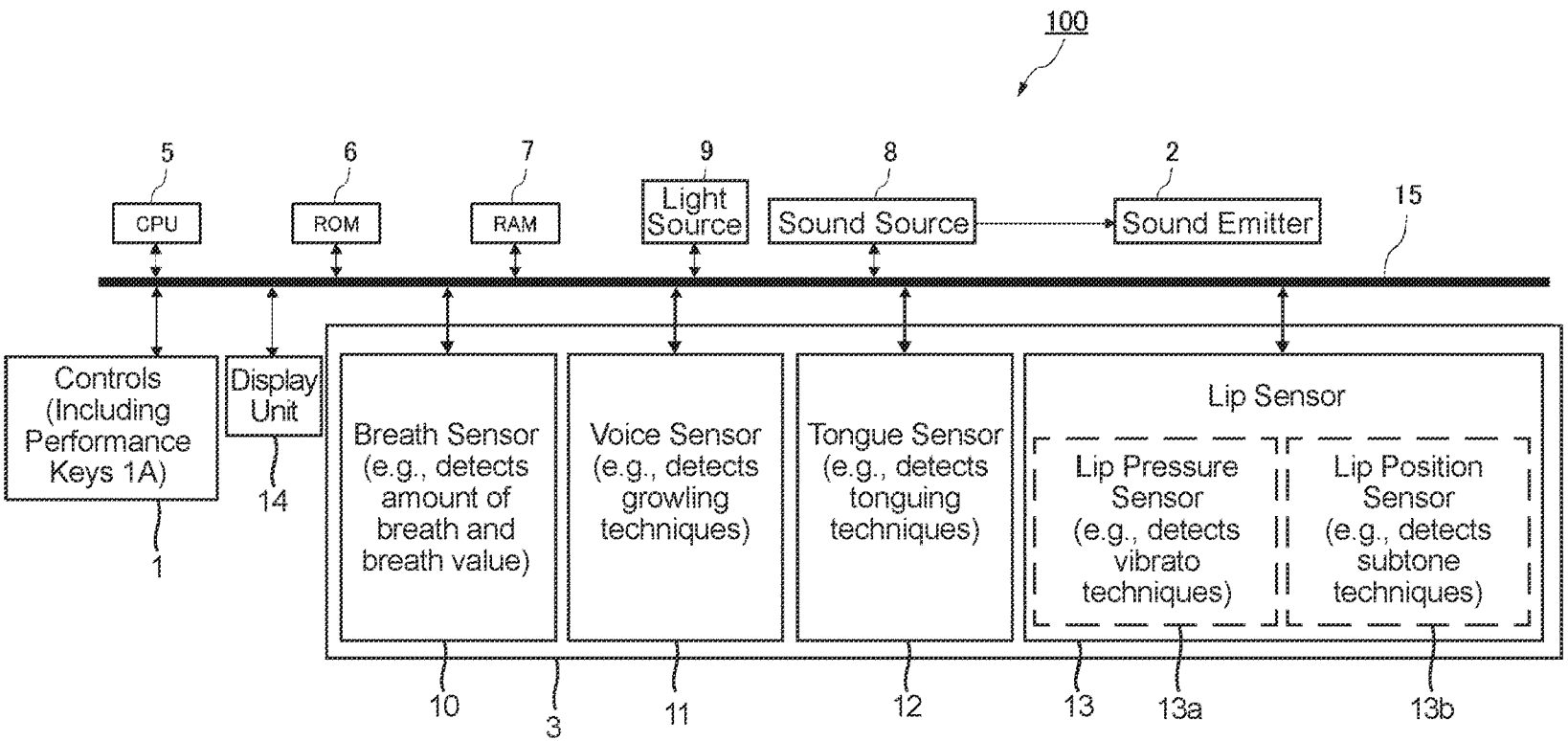
FIG. 2 is a block diagram of the electronic wind instrument according to the embodiment of the present invention.
Figure 3:
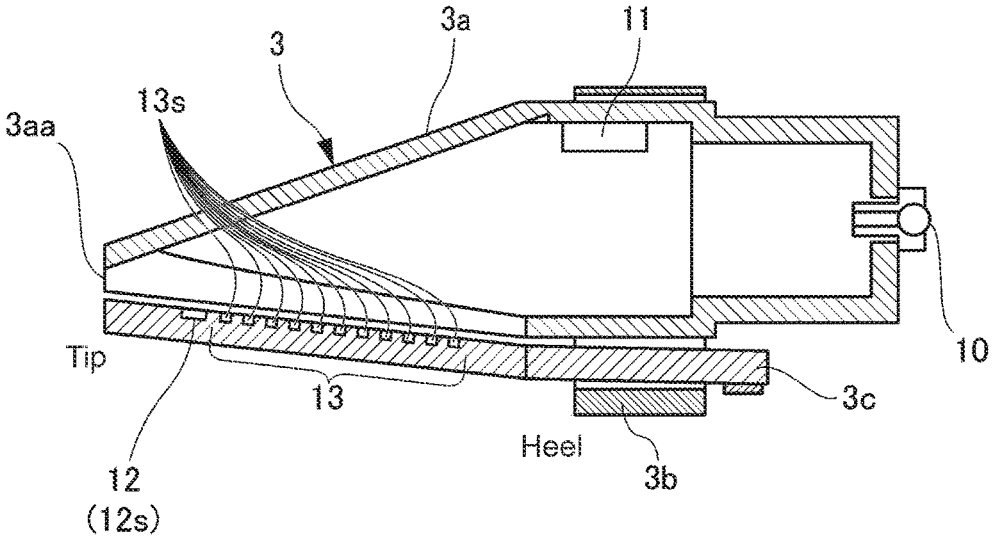
FIG. 3 is a cross-sectional view of a mouthpiece of the embodiment of the present invention.

FIGS. 1A and 1B illustrate an electronic wind instrument 100 according to the embodiment of the present invention, where FIG. 1A is a front view of the electronic wind instrument 100 and FIG. 1B is a side view of the electronic wind instrument 100. FIG. 2 is a block diagram of the electronic wind instrument 100, and FIG. 3 is a cross-sectional view of a mouthpiece 3.

Note that in FIG. 1A, a portion of a body 100*a* is removed in order to show the interior of the electronic wind instrument 100.

Although in the present embodiment the electronic wind instrument 100 will be described as being a saxophone as an example, the electronic wind instrument 100 of the present invention may alternatively be an electronic wind instrument other than a saxophone (such as a clarinet, for example).

As illustrated in FIGS. 1A and 1B, the electronic wind instrument 100 includes a body 100*a* formed in the shape of a saxophone, controls 1 including a plurality of performance keys 1A arranged on the outer surface of the body 100*a*, a sound emitter 2 arranged on a distal end side of the body 100*a*, and a mouthpiece 3 arranged on a base end side of the body 100*a*.

Moreover, as illustrated in FIG. 1A, the electronic wind instrument 100 further includes a circuit board 4 arranged within the base end side of the body 100*a*, and components such as a central processing unit (CPU, processor) 5, a read-only memory (ROM) 6, a random-access memory (RAM) 7, and a sound source 8 are mounted on that circuit board 4.

Furthermore, as illustrated in FIG. 3, the mouthpiece 3 includes a mouthpiece body 3*a*, a metal fitting 3*b* arranged on the mouthpiece body 3*a*, a reed 3*c* attached to the mouthpiece body 3*a* by the metal fitting 3*b*, a breath sensor 10 arranged on an end side of the mouthpiece body 3*a*, a voice sensor 11 arranged inside the mouthpiece body 3*a*, a tongue sensor 12 arranged on the reed 3*c*, and a lip sensor 13 arranged on the reed 3*c*.

Moreover, the lip sensor 13 includes a lip pressure sensor 13*a* and a lip position sensor 13*b* (described below).

The electronic wind instrument 100 further includes a display unit 14 (see FIG. 2) arranged on the outer surface of the body 100*a*.

The display unit 14 includes a touch sensor-equipped liquid crystal screen, for example, and not only displays various types of information but can also be used to configure various settings.

In addition, as illustrated in FIG. 2, the electronic wind instrument 100 further includes a light source 9 for making the performance keys 1A emit light.

The light source 9 includes LEDs arranged on each of the performance keys 1A and an LED control driver and the like for controlling those LEDs, for example, and illuminates the performance keys 1A that the performer should press to provide a performance guide, as will be described later.

Furthermore, each of these functional components (such as the controls 1, the CPU 5, the ROM 6, the RAM 7, the sound source 8, the light source 9, the breath sensor 10, the voice sensor 11, the tongue sensor 12, the lip sensor 13, and the display unit 14) are connected via a bus 15.

The controls 1 form an operation unit which is operated by the performer's (user's) fingers, and include the performance keys 1A for specifying pitches and settings keys 1B for configuring a feature for changing pitch in accordance with the key of a musical piece, a feature for fine-tuning pitch, and the like.

The sound emitter 2 performs a signal amplification process or the like on musical note signals input from the sound source 8 (described below) and outputs the resulting signals from a built-in speaker as musical notes.

Note that although the sound emitter 2 is built into the electronic wind instrument 100 in the present embodiment, the sound emitter 2 is not limited to being a built-in component and may alternatively be an external component which is connected to an external output port (not illustrated in the figure) of the electronic wind instrument 100.

The CPU 5 functions as a controller which controls the components of the electronic wind instrument 100 and reads and loads specified programs from the ROM 6 to the RAM 7 and then executes the loaded programs to perform various processes.

For example, the CPU 5 outputs, to the sound source 8, control data for controlling emission and silencing of sounds from the sound emitter 2 on the basis of musical piece data (MIDI data), breath input operations to the mouthpiece 3 as detected by the breath sensor 10, and the like, and thus controls the sound emitter 2 so as to emit sounds, controls the sound emitter 2 so as to silence sounds, and the like (this will be described in more detail later).

Moreover, the CPU 5 also, on the basis of the musical piece data (MIDI data), controls the light source 9 so as to illuminate the performance keys 1A that should be pressed from among the plurality of performance keys 1A, for example (this will also be described in more detail later).

The ROM 6 is a read-only storage unit and stores programs for controlling the components of the electronic wind instrument 100, the musical piece data (MIDI data; described later), and the like.

The RAM 7 is a read-write storage unit and functions as a working area which temporarily stores data obtained from the sensors (such as the breath sensor 10, the voice sensor 11, the tongue sensor 12, and the lip sensor 13) as well as programs, musical piece data, and the like.

The sound source 8, in accordance with the control data from the CPU 5 based on operation information from the controls 1 as well as data obtained from the sensors and the like, generates musical note signals and outputs those musical note signals to the sound emitter 2.

The mouthpiece 3, which is held in the performer's mouth during a performance, includes various sensors (such as the breath sensor 10, the voice sensor 11, the tongue sensor 12, and the lip sensor 13) and detects various types of performance operations produced by the performer's tongue, breath, voice, and the like.

Next, the sensors (such as the breath sensor 10, the voice sensor 11, the tongue sensor 12, and the lip sensor 13) will be described in more detail.

Note that the following description of the features and the like of the sensors focuses on the main features or the like, and other features may also be added, for example.

The breath sensor 10 includes a pressure sensor, and the breath sensor 10 detects breath values such as the amount of breath and breath pressure blown by the performer into an inlet 3*aa* for taking in breath on the base end side of the mouthpiece body 3*a*.

Here, the breath values are obtained as output signals from the breath sensor 10, and breath input operations are detected by obtaining these breath values.

Moreover, the breath values detected by the breath sensor 10 are used by the CPU 5 to turn musical notes on and off and to set the volume and the like of musical notes.

Furthermore, the breath values detected by the breath sensor 10 are also used by the CPU 5 to determine the volume of tremolo effects.

The voice sensor 11 includes a microphone, and the voice sensor 11 detects voice input (growling waveforms) for growling techniques from the performer.

Here, the voice input (growling waveforms) detected by the voice sensor 11 is used by the CPU 5 to determine synthesizing ratios for growling waveform data.

The tongue sensor 12 includes a pressure sensor or a capacitive sensor having a detector 12*s* arranged at a position on the base endmost side (tip side) of the reed 3*c*, and the tongue sensor 12 detects for contact of the tongue (that is, detects for tonguing) at that position on the base end side of the reed 3*c*.

Here, the tongue contact state detected by the tongue sensor 12 is used by the CPU 5 to turn musical notes on and off, and the tongue contact state is also used in conjunction with the breath value detection state from the breath sensor 10 to set pitch.

The lip sensor 13 includes a pressure sensor or a capacitive sensor having a plurality of detectors 13*s* arranged going from the base end side (tip side) to the distal end side (heel side) of the reed 3*c* and functions as the lip pressure sensor 13*a* and the lip position sensor 13*b*.

More specifically, the lip sensor 13 functions as the lip position sensor 13*b*, which detects lip position on the basis of which detector 13*s* of the plurality of detectors 13*s* detects contact of the lip, and the lip sensor 13 also functions as the lip pressure sensor 13*a*, which detects the contact strength of that contacting lip.

Moreover, when the plurality of detectors 13*s* detect contact of the lip, the CPU 5 obtains the lip position by obtaining the center contact position on the basis of the output from the lip sensor 13.

For example, when the lip sensor 13 includes a pressure sensor, lip contact strength (lip pressure) and lip position are detected on the basis of changes in the pressure detected by the pressure sensor.

Meanwhile, when the lip sensor 13 includes a capacitive sensor, lip contact strength (lip pressure) and lip position are detected on the basis of changes in the capacitance detected by the capacitive sensor.

Furthermore, the lip contact strength (lip pressure) detection results from the lip sensor 13 when functioning as the lip pressure sensor 13*a* as well as the lip position detection results from the lip sensor 13 when functioning as the lip position sensor 13*b* are used to control vibrato effects and subtone effects.

More specifically, the CPU 5 detects vibrato techniques and performs a process corresponding to vibrato on the basis of changes in lip contact strength (lip pressure) and also detects subtone techniques and performs a process corresponding to subtones on the basis of changes in lip position (changes in position, contact area, or the like).

In addition, although the electronic wind instrument 100 makes it possible for a performer to play using the same techniques as when playing a standard saxophone, the electronic wind instrument 100 according to the embodiment further makes it possible to practice in a manner targeted at efficiently improving the performance ability of a beginner, for example. This will be described in more detail below.

As was briefly described above, the ROM 6 stores musical piece data known as so-called MIDI data.

This musical piece data includes data for using the sound emitter 2 of the electronic wind instrument 100 (here, a saxophone; hereinafter, also referred to as the "main musical instrument") to emit sounds for an accompaniment or the like by musical instruments other than the main musical instrument, data for making the main musical instrument play autonomously, and the like.

For example, the data for making the main musical instrument play autonomously has markers (hereinafter, also referred to as "identifiers") corresponding to segments to be played with each breath (hereinafter, also referred to as "breath input operation segments"), and each breath input operation segment includes timing information (note-on data) for sounds that should be sequentially emitted from the sound emitter 2 as well as information (continuous data) for, after a sound begins to be emitted, making that emitted sound continue to be emitted until emission of the next sound.

Furthermore, as will be described in more detail later with reference to the flowcharts and the like illustrated in FIGS. 4 and 5, the electronic wind instrument 100 according to the present embodiment uses this musical piece data to provide a comprehensive practice mode (first mode) in which the performer practices both breath input operations and operation of the performance keys 1A, a breathing practice mode (second mode) for focusing on practicing the breathing, and the like.

The comprehensive practice mode (first mode) is a mode similar to normal performance mode, in which when a breath input operation and operation of the performance keys 1A occurs, the CPU 5 makes the sound source 8 generate a musical note signal (first sound waveform data) to be output to the sound emitter 2 on the basis of the breath input operation and operation of the performance keys 1A, and the generated first sound waveform data is then output from the sound emitter 2 on the basis of detection of the breath input operation. One difference from the normal performance mode is that the CPU 5 also performs a control process to provide a performance guide, for example.

More specifically, to provide the performance guide, the CPU 5 performs a control process of making the light source 9 illuminate the performance keys 1A that should be pressed by the performer at the timing at which those keys should be pressed and also makes the light source 9 stop illuminating the performance keys 1A at the timing at which those performance keys 1A should stop being pressed.

In the breathing practice mode (second mode), the performer only performs breath input operations corresponding to breath input operation segments, and sounds are emitted from the sound emitter 2 on the basis of, in the musical piece data, the timing information (note-on data) for sounds that should be emitted from the sound emitter 2 and the information (continuous data) for, after a sound begins to be emitted, making that emitted sound continue to be emitted until emission of the next sound. In this way, sounds are emitted from the sound emitter 2 without the performer having to operate the performance keys 1A.

In other words, in the breathing practice mode (second mode), when the breath sensor 10 detects a breath input operation, instead of making the sound emitter 2 output the expected output sound waveform data that should be generated and output on the basis of the breath input operation and operation of the performance keys 1A, the CPU 5 makes the sound source 8 generate second sound waveform data based on the musical piece data regardless of whether operation of the performance keys 1A is detected or is not, and then, on the basis of the detection of the breath input operation, makes the sound emitter 2 emit (output) the sound of that second sound waveform data generated on the basis of the musical piece data.

In this way, the CPU 5 performs a control process of, regardless of any operation of the performance keys 1A, making the sound emitter 2 emit sounds based on the musical piece data when the breath sensor 10 detects breath input operations. This allows the performer to focus on practicing breath input operations corresponding to breath input operation segments so as not to take unnecessary breaths midway.

Therefore, the breathing practice mode (second mode) makes it possible to focus on practicing breathing without having to worry about operation of the performance keys 1A, thereby making it possible to efficiently learn the breathing.

Moreover, as described above, the data for making the main musical instrument play autonomously has markers (identifiers) corresponding to segments to be played with each breath (breath input operation segments), and therefore while practicing in the breathing practice mode, the breath input operation segments that are specified by the performer can be practiced as practice segments rather than practicing the entire musical piece as a unit.

In other words, the performer can select and set arbitrary breath input operation segments of the musical piece data, thereby making it possible for the performer to practice breath input operation segments that he/she particularly wants to practice (such as two sequential breath input operation segments or a breath input operation segment for a single breath, for example) in a more focused manner.

More specifically, in wind instruments, it is common for there to be a plurality of sequential musical notes within a segment played with a single breath (a breath input operation segment), and thus the performer must continue the breath input operation until the sounds corresponding to those musical notes have all been emitted and then stop the breath input operation at the timing at which to end the sound corresponding to the last musical note.

Therefore, if there are three sequential musical notes within a single breath input operation segment, for example, when that breath input operation segment is set as a practice segment, this would configure a session of practicing the appropriate breath input operation (continuous breath input operation) for making the sound emitter 2 emit the sounds corresponding to those three musical notes.

Next, the breathing practice mode and the like will be described in more detail with reference to FIGS. 4 and 5.

Figure 4:
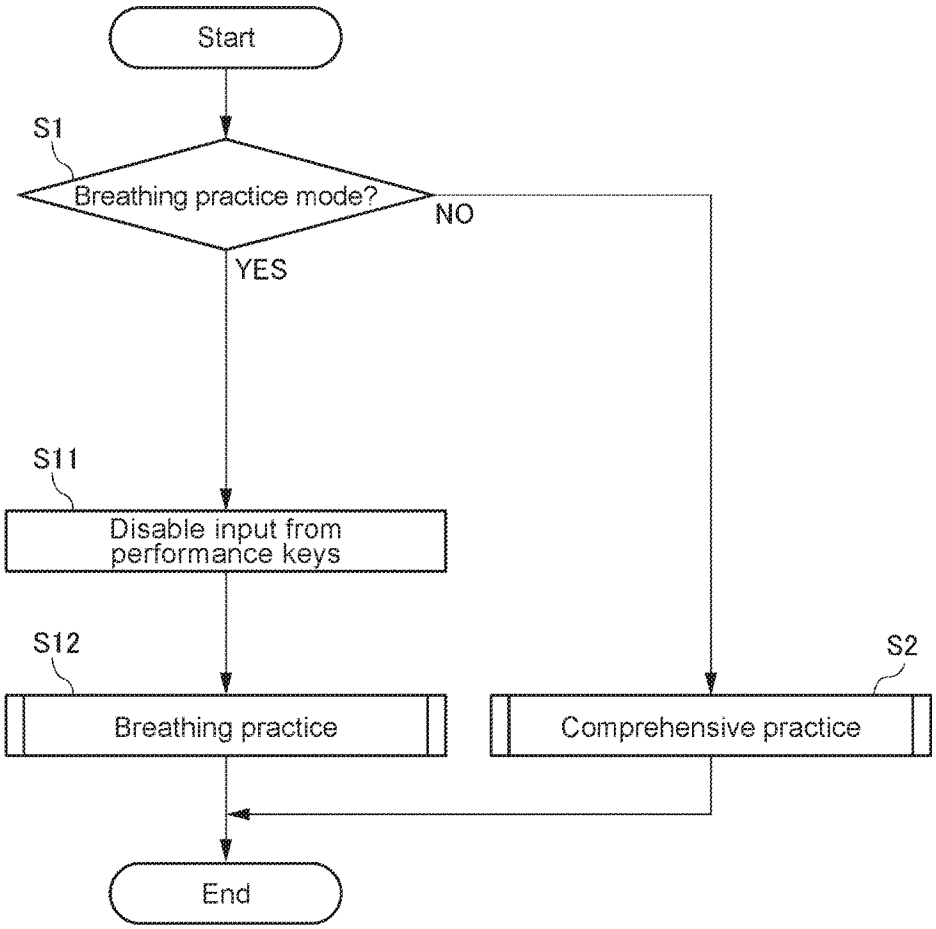
FIG. 4 is a flowchart illustrating a main routine of a practice mode process.
Figure 5:
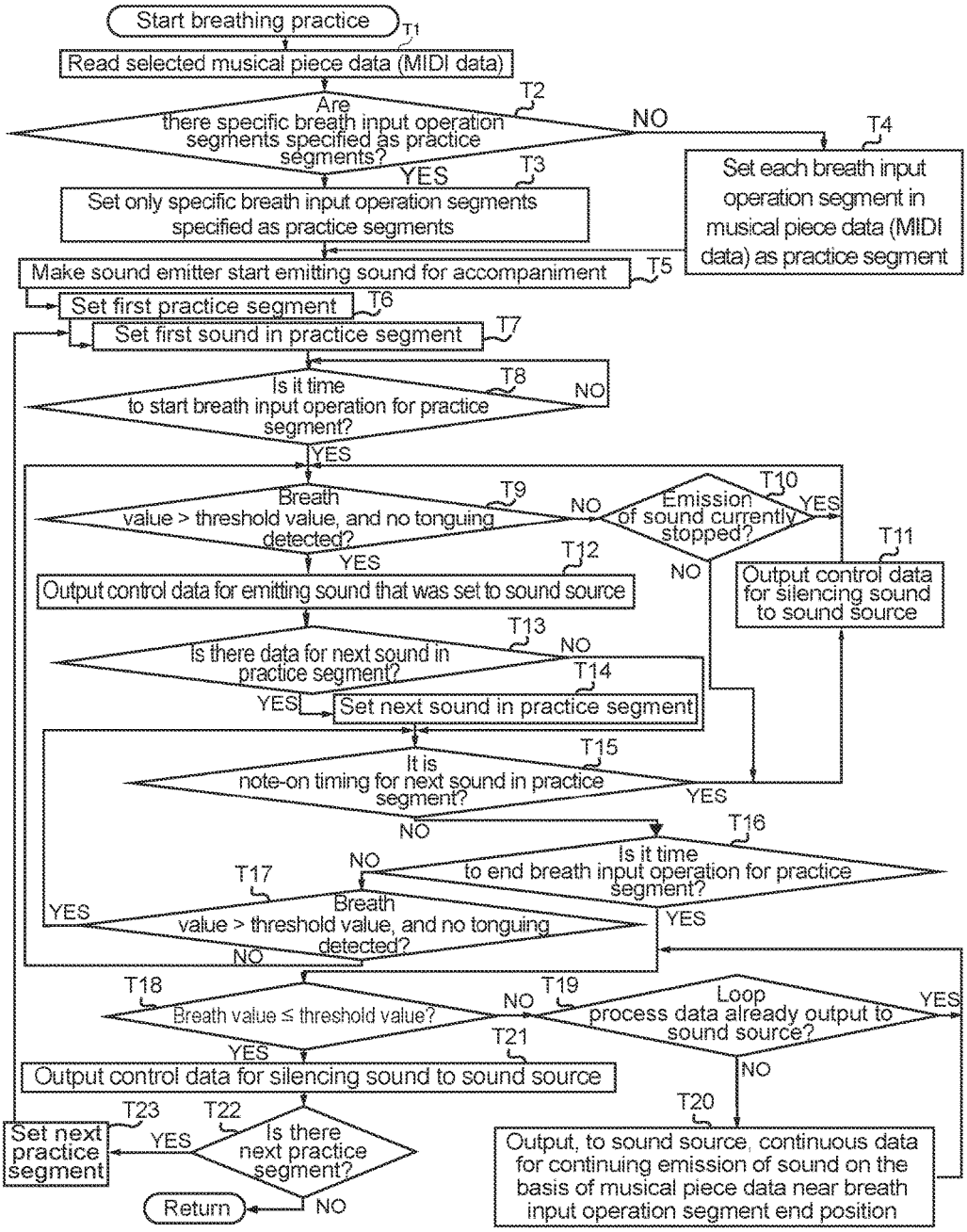
FIG. 5 is a flowchart of a breathing practice mode (second mode), which is a subroutine of the main routine illustrated in FIG. 4.

FIG. 4 is a flowchart illustrating a main routine of a practice mode process, and FIG. 5 is a flowchart of the breathing practice mode (second mode), which is a subroutine of the main routine illustrated in FIG. 4.

The main routine process illustrated in FIG. 4 begins when the performer selects either the comprehensive practice mode (first mode) or the breathing practice mode (second mode) from among the practice modes and then specifies which musical piece to play.

As described above, the electronic wind instrument 100 according to the present embodiment makes it possible to select and set arbitrary breath input operation segments of the musical piece data (MIDI data) as practice segments.

Therefore, when a particular breath input operation segment is set as a practice segment, the main routine process illustrated in FIG. 4 begins after the performer selects a musical piece to play, selects the desired breath input operation segment to be practiced, and then sets the selected breath input segment as a practice segment.

Once the main routine process illustrated in FIG. 4 begins, in step S1, the CPU 5 determines whether the practice mode selected by the performer is the breathing practice mode (second mode).

Upon determining in step S1 that the practice mode is the breathing practice mode (second mode) (YES in step S1), the CPU 5 proceeds to step S11 and disables input from the performance keys 1A and then proceeds to step S12 and executes a breathing practice process (described later with reference to FIG. 5).

Meanwhile, upon determining in step S1 that the practice mode is not the breathing practice mode (second mode) (NO in step S1), the CPU 5 determines that the practice mode selected by the performer is the comprehensive practice mode (first mode) and then proceeds to step S2 and executes a comprehensive practice process.

In this way, the CPU 5 performs a control process of selectively switching between the comprehensive practice mode (first mode) and the breathing practice mode (second mode) in accordance with the performer's selection.

Here, "comprehensive practice" refers to a practice mode in which a part (such as an accompaniment) by a musical instrument other than the main musical instrument is played automatically on the basis of the musical piece data (MIDI data) and the performer is responsible for all aspects of playing the main musical instrument (such as the breathing and operating the performance keys 1A). As described above, except for the CPU 5 performing a control process to provide a performance guide, this mode is substantially the same as normal performance mode, and therefore a description of this mode will be omitted here.

However, if the performer selects a breath input operation segment he/she wants to practice and then sets that selected breath input operation segment as a practice segment as described above, the process is only performed for that practice segment, even when in comprehensive practice mode.

Once the process for the breathing practice mode (second mode) in step S12 or the comprehensive practice mode (first mode) in step S2 is complete, the main routine process illustrated in FIG. 4 ends.

Next, the breathing practice process executed by the CPU 5 will be described with reference to FIG. 5.

The CPU 5 begins the process shown in the breathing practice flowchart illustrated in FIG. 5 upon proceeding to step S12 after the performer selects the breathing practice mode (second mode) as described above.

In step T1, the CPU 5 executes a process of loading the musical piece data (MIDI data) selected by the performer from among the musical piece data stored in the ROM 6 into the RAM 7 (which functions as a working area), and then proceeds to step T2.

In step T2, the CPU 5 determines whether there are any specific breath input operation segments for the musical piece data that the performer has set as practice segments. If the CPU 5 determines in step T2 that there are specific breath input operation segments for the musical piece data that have been specified by the performer (YES in step T2), the CPU 5 proceeds to step T3 and sets, as practice segments, only the specific breath input operation segments specified by the performer from among the breath input operation segments in the musical piece data (MIDI data).

Note that as described above, the breath input operation segments set as practice segments can include a single breath input operation segment or a plurality of breath input operation segments.

Therefore, in the process of setting the practice segments in step T3, if there are a plurality of breath input operation segments that have been specified as practice segments, each of those breath input operation segments is set as a respective practice segment.

Meanwhile, if the CPU 5 determines in step T2 that there are no specific breath input operation segments of the musical piece data that were specified by the performer (NO in step T2), the CPU 5 proceeds to step T4 and sets each of the breath input operation segments in the musical piece data as a practice segment.

Upon completing the process in step T3 or step T4, the CPU 5 proceeds to step T5 and makes the sound emitter 2 start emitting sound for an accompaniment (a part played by a musical instrument other than the main musical instrument) on the basis of the musical piece data.

More specifically, in accordance with musical piece data, the CPU 5 sequentially outputs control data such as note data (note-on data, note-off data, and the like) and continuous data corresponding to the accompaniment to the sound source 8 and thus makes the sound source 8 generate musical note signals and send those musical note signals to the sound emitter 2, which causes the sound emitter 2 to emit sounds corresponding to those musical note signals.

Moreover, although a description of the accompaniment portion will be omitted below, in the present embodiment, when the performer stops a breath input operation midway (that is, when the performance of the main musical instrument stops due to being unable to perform a breath input operation during a period in which the breath input operation should be continued, for example), the automatically-played accompaniment is also set to a stopped state, and then the automatically-played accompaniment is resumed from that point once the breath input operation is resumed.

After beginning emission of the accompaniment (step T5), the CPU 5 proceeds to step T6 and executes a process of setting the first practice segment (the breath input operation segment of the musical piece data to be set first). Then, the CPU 5 proceeds to step T7 and sets the first sound in that practice segment that was set (that is, the sound for the first set of second sound waveform data among one or more sets of second sound waveform data based on the musical piece data for the practice segment).

Next, the CPU 5 proceeds to step T8 and monitors for a timing of a breath input operation within the practice segment for beginning to emit the sound that was set.

In other words, in step T8 the CPU 5 continuously determines whether a timing at which to begin the breath input operation within the practice segment has occurred, and then, upon determining that this breath input operation start timing has occurred (YES in step T8), the CPU 5 proceeds to step T9.

Upon proceeding to step T9, the CPU 5 determines whether the performer has put the main musical instrument into a state in which sound should be emitted.

More specifically, the CPU 5 determines whether the performer has performed a breath input operation that causes the breath value output from the breath sensor 10 to become greater than threshold value and also determines from the tongue contact (tonguing) detection state from the tongue sensor 12 whether the instrument is in state that should stop emission of sound.

If the breath value is less than or equal to the threshold value and the tongue sensor 12 does not detect a no-tonguing state (NO in step T9), the CPU 5 proceeds to step T10 and determines whether emission of sound from the sound emitter 2 of the main musical instrument is currently stopped. If it is determined in step T10 that sound is currently being emitted (NO in step T10), the CPU 5 proceeds to step T11 and performs a control process of outputting control data for silencing the sound from the main musical instrument (note-off data) to the sound source 8 in order to silence emission of sound from the sound emitter 2, and then returns to step T9 and again determines whether the breath value is greater than the threshold value and whether the instrument is currently in a no-tonguing state.

Meanwhile, if it is determined in step T10 that emission of sound is currently stopped (YES in step T10), the CPU 5 skips step T11 and immediately returns to step T9 to determine whether the breath value is greater than the threshold value and whether the instrument is currently in a no-tonguing state.

In other words, the CPU 5 performs a control process of waiting and not proceeding to step T12 until the breath value is greater than the threshold value and a no-tonguing state is detected (YES in step T9).

Then, once the determination in step T9 yields YES, the CPU 5 proceeds to step T12 and performs a control process of outputting control data (note-on data, continuous data) for emitting the sound set in step T7 (the sound for the first set of second sound waveform data based on the musical piece data) to the sound source 8 in order to make the sound emitter 2 emit that sound.

Next, the CPU 5 proceeds to step T13 and determines whether there is data for a next sound (a next set of second sound waveform data based on the musical piece data) in the practice segment.

If the CPU 5 determines in step T13 that there is data for a next sound (a next set of second sound waveform data based on the musical piece data) (YES in step T13), the CPU 5 proceeds to step T14, executes a process of setting the next sound (the next set of second sound waveform data based on the musical piece data) in the practice segment, and then proceeds to step T15.

Meanwhile, if it is determined in step T13 that there is not any data for a next sound (no next set of second sound waveform data based on the musical piece data) (NO in step T13), the CPU 5 proceeds to step T15 without performing the process of step T14.

Next, in step T15, the CPU 5 determines whether a note-on (emission) timing of the next sound (the sound for the next set of second sound waveform data based on the musical piece data) has occurred. If it is determined that the note-on (emission) timing of the next sound (the sound for the next set of second sound waveform data based on the musical piece data) has occurred (YES in step T15), the CPU 5 proceeds to step T11 and executes the process of silencing the current sound from the sound emitter 2 and then returns to step T9 and step T12 and performs the control process of making the sound emitter 2 emit the next sound (the sound for the next set of second sound waveform data based on the musical piece data).

Upon proceeding to step T9 via step T15 and step T11, if the determination in step T9 does not yield YES because the performer has paused to take a breath or the like, for example, as described above, the CPU 5 does not proceed to step T12 and instead performs the control process of waiting to emit sounds until the performer puts the main musical instrument into a state in which sound should be emitted, such as once the breath input operation is resumed.

Meanwhile, if the CPU 5 determines in step T15 that the note-on (emission) timing of the next sound has not yet occurred (NO in step T15), the CPU 5 proceeds to step T16 and determines whether an end timing of the breath input operation for the practice segment has occurred.

Then, if it is determined in step T16 that the breath input operation end timing has not yet occurred (NO in step T16), the CPU 5 proceeds to step T17 and performs the same determination as in step T9.

If it is determined in step T17 that the breath value is greater than the threshold value and a no-tonguing state is detected (YES in step T17), this means that the instrument is still in a state in which sound should be emitted, and therefore the CPU 5 returns to step T15.

In other words, while the instrument continues to be in a state in which sound should be emitted, the current sound continues to be emitted, and the CPU 5 performs a control process of waiting for either the note-on timing of the next sound (the sound for the next set of second sound waveform data based on the musical piece data) (step T15) or the breath input operation end timing (step T16) to occur.

During this waiting process, if the performer pauses to take a breath or the like, the breath value from the breath sensor 10 becomes less than or equal to the threshold value, which causes the determination in step T17 to yield NO. In other words, the CPU 5 determines that the breath value is less than or equal to the threshold value and that the no-tonguing state is no longer detected, and therefore the CPU 5 returns to step T9 and then performs the control process of silencing any sounds currently being emitted.

More specifically, because the determination in step T9 is the same as in step T17, upon proceeding to step T9, the CPU 5 determines that the breath value is less than or equal to the threshold value and that a no-tonguing state is not detected (NO in step T9). Moreover, in this case the current sound is currently being emitted, and therefore the determination in step T10 yields NO, causing the CPU 5 to proceed to step T11 and output control data for silencing the sound (note-off data) to the sound source 8 in order to silence emission of sound from the sound emitter 2, and then return to step T9, where, as described above, the CPU 5 does not proceed to step T12 and instead performs the control process of waiting to emit sounds until the performer puts the main musical instrument into a state in which sound should be emitted, such as once the breath input operation is resumed.

Then, once the performer resumes the breath input operation, the breath value from the breath sensor 10 becomes greater than the threshold value, and the determination in step T9 yields YES, so the CPU 5 proceeds to step T12 and emits the next sound that has been set.

In other words, after the breath sensor 10 detects a breath input operation and a sound for the one or more sets of second sound waveform data generated on the basis of the musical piece data from the sound emitter 2, when the breath sensor 10 detects that the breath input operation has ended before the end of the current breath input operation segment of the musical piece data (that is, the breath input operation is no longer detected) and the breath sensor 10 then detects another breath input operation, the CPU 5 performs a control process of making the sound emitter 2 emit (output) a sound for fourth sound waveform data (the next set of second sound waveform data based on the musical piece data) that has not yet been output in the currently set practice segment (the currently set breath input operation segment of the musical piece data).

Meanwhile, once the end timing of the breath input operation for the practice segment occurs, the determination in step T16 yields YES, and therefore the CPU 5 proceeds to step T18 and determines whether the breath value is now less than or equal to the threshold value.

Normally, when step T16 yields YES, this would indicate that it is time to take a breath or that it is time for the performance to end, in which case the CPU 5 would proceed to step T21 and execute a silencing process. However, the performer will not necessarily always stop breath input operations at the times at which step T16 yields YES.

Moreover, executing the silencing process when the performer has not yet stopped a breath input operation would be unnatural for the performer, and therefore upon determining in step T18 that the breath value is not less than the threshold value (NO in step T18) and that the breath sensor 10 is still detecting a breath input operation even after the end position of the currently set practice segment (the currently set breath input operation segment of the musical piece data), the CPU 5 performs a control process of making the sound emitter 2 continue to emit sound.

More specifically, the CPU 5 proceeds to step T19 and determines whether loop process data has already been output to the sound source 8 due to step T20 having been previously executed, and if it is determined that loop process data has not yet been output to the sound source 8 (NO in step T19), the CPU 5 then proceeds to step T20.

Then, in step T20, the CPU 5 performs a control process of outputting, to the sound source 8, continuous data (loop process data) for continuing emission of sound on the basis of the musical piece data near the end position of the currently set practice segment (the currently set breath input operation segment of the musical piece data) and thereby making the sound emitter 2 emit (output) a sound for sound waveform data (fifth sound waveform data) based on this loop process data until the determination in step T18 yields YES.

Note that the sound waveform data (fifth sound waveform data) based on this loop process data will also be referred to as sound waveform data based on the musical piece data near the end position of the breath input operation segment.

More specifically, data from a range of approximately 10% of the continuous data for the sound prior to the end position of the currently set practice segment (the currently set breath input operation segment of the musical piece data) is set as the loop process data, for example, and this loop process data is repeatedly used to make the sound emitter 2 continue to emit sound until the determination in step T18 yields YES.

However, if the sound immediately prior to the end position of the currently set practice segment (the currently set breath input operation segment of the musical piece data) is a vibrato sound, it is preferable that the sound waveform data (fifth sound waveform data) based on the loop process data have approximately the same level of vibrato effect applied thereto for the entire looped segment, for example, so that the sound emitter 2 continues to output sound waveform data having a vibrato effect applied thereto.

Next, if the CPU 5 determines in step T18 that the breath value is less than the threshold value (YES in step T18), the CPU 5 proceeds to step T21 and performs a control process of outputting control data for silencing sound (note-off data) to the sound source 8 in order to silence the sound emitter 2 and then proceeds to step T22.

In step T22, the CPU 5 determines whether there is a next practice segment, and if it is determined that there is a next practice segment (YES in step T22), the CPU 5 proceeds to step T23 and sets the next practice segment (the next breath input operation segment of the musical piece data) and then executes the process starting from step T7 again.

Meanwhile, if it is determined in step T22 that there is no next practice segment (NO in step T22), the CPU 5 returns to the main routine illustrated in FIG. 4 and then ends the overall process.

As described above, the electronic wind instrument 100 according to the present embodiment makes it possible to separately focus on practicing breath input operations, thereby making it possible to efficiently improve performance ability.

In other words, in the electronic wind instrument 100 according to the present embodiment, when a breath input operation is detected, instead of outputting the sound waveform data that should be generated and output on the basis of the breath input operation and operation of the performance keys 1A, sound waveform data generated on the basis of the musical piece data is output, regardless of whether operations of the performance keys 1A are detected or are not detected. Thus, even if the performer does not operate the performance keys 1A, as long as breath input operations are performed, music based on the musical piece data is output, which makes it possible to practice the breath input operations unique to wind instruments in a focused manner.

(Modification Example of Second Mode)

The second mode described above is specifically designed to allow the performer to focus on practicing breath input operations corresponding to breath input operation segments so as not to take unnecessary breaths midway.

Therefore, performance effects such as vibrato which are difficult for beginners are achieved by using the musical piece data, for example.

However, even when utilizing this type of assisted performance based on the musical piece data, accurately reflecting the state of the performer's breathing can make it possible to not only practice simply breathing correctly during breath input operation segments but to also practice more expressive breathing.

Therefore, next, a modification example of the second mode in which effects such as vibrato, growling, and subtones reflect the performer's breathing instead of being performed in a completely assisted manner based on the musical piece data will be described.

Figure 6:
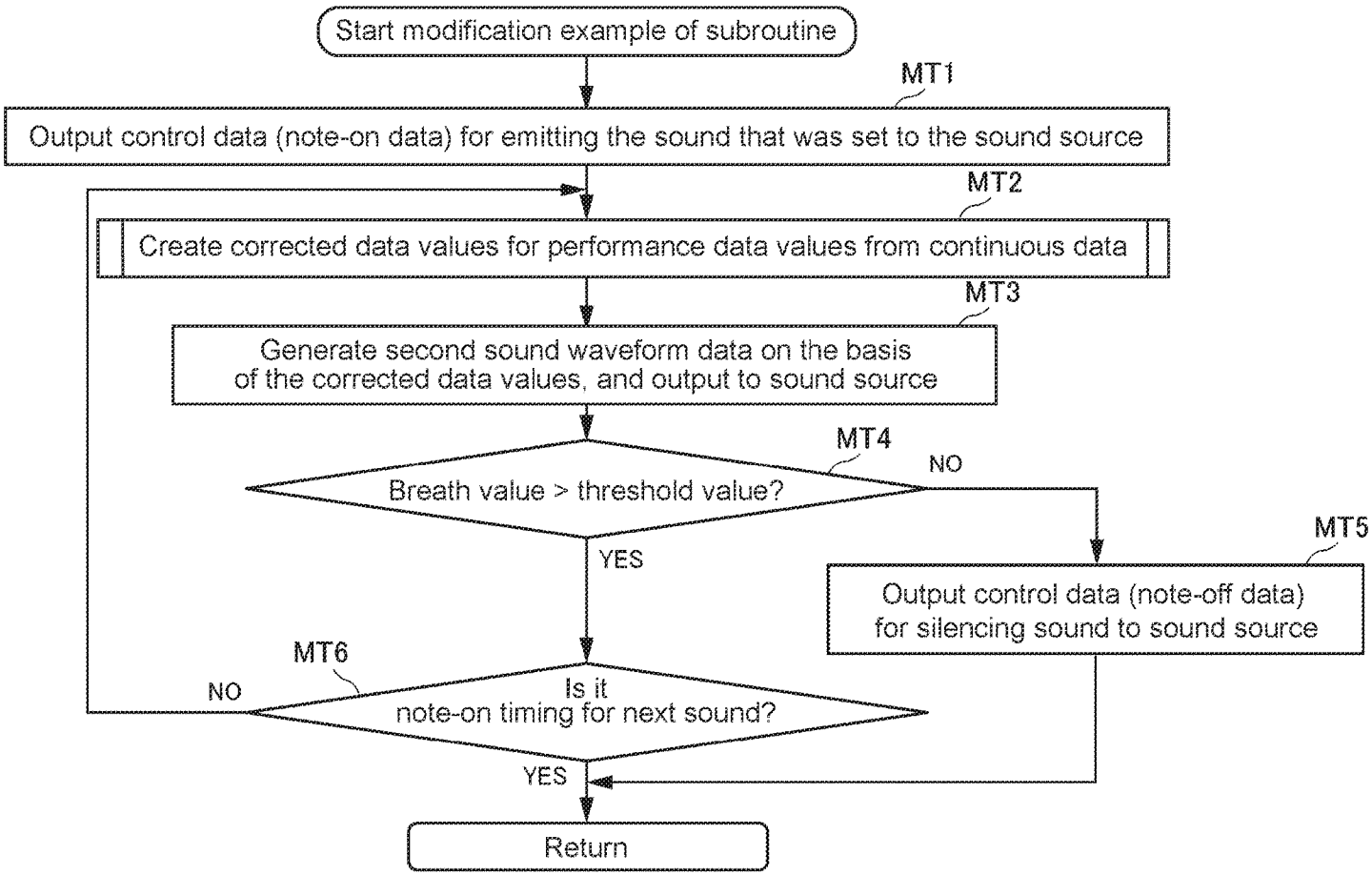
FIG. 6 is a flowchart illustrating a subroutine according to a modification example of the second mode.

More specifically, step T12 in the flowchart illustrated in FIG. 5 should be replaced with the subroutine for the modification example of the second mode illustrated in FIG. 6.

In other words, upon proceeding to step T12 as described above, the subroutine process illustrated in FIG. 6 is performed.

Once the subroutine illustrated in FIG. 6 is started, the CPU 5 proceeds to step MT1 and performs a control process of outputting control data (note-on data) for emitting sound for the specified second sound waveform data to the sound source 8 in order to make the sound emitter 2 start emitting that sound.

Next, the CPU 5 proceeds to step MT2 and creates corrected data values for performance data values in the continuous data from the musical piece data (MIDI data), which is control data for temporally altering the sound for the second sound waveform data in a continuous manner during the period from the current note-on until the next note-on.

Figure 7:
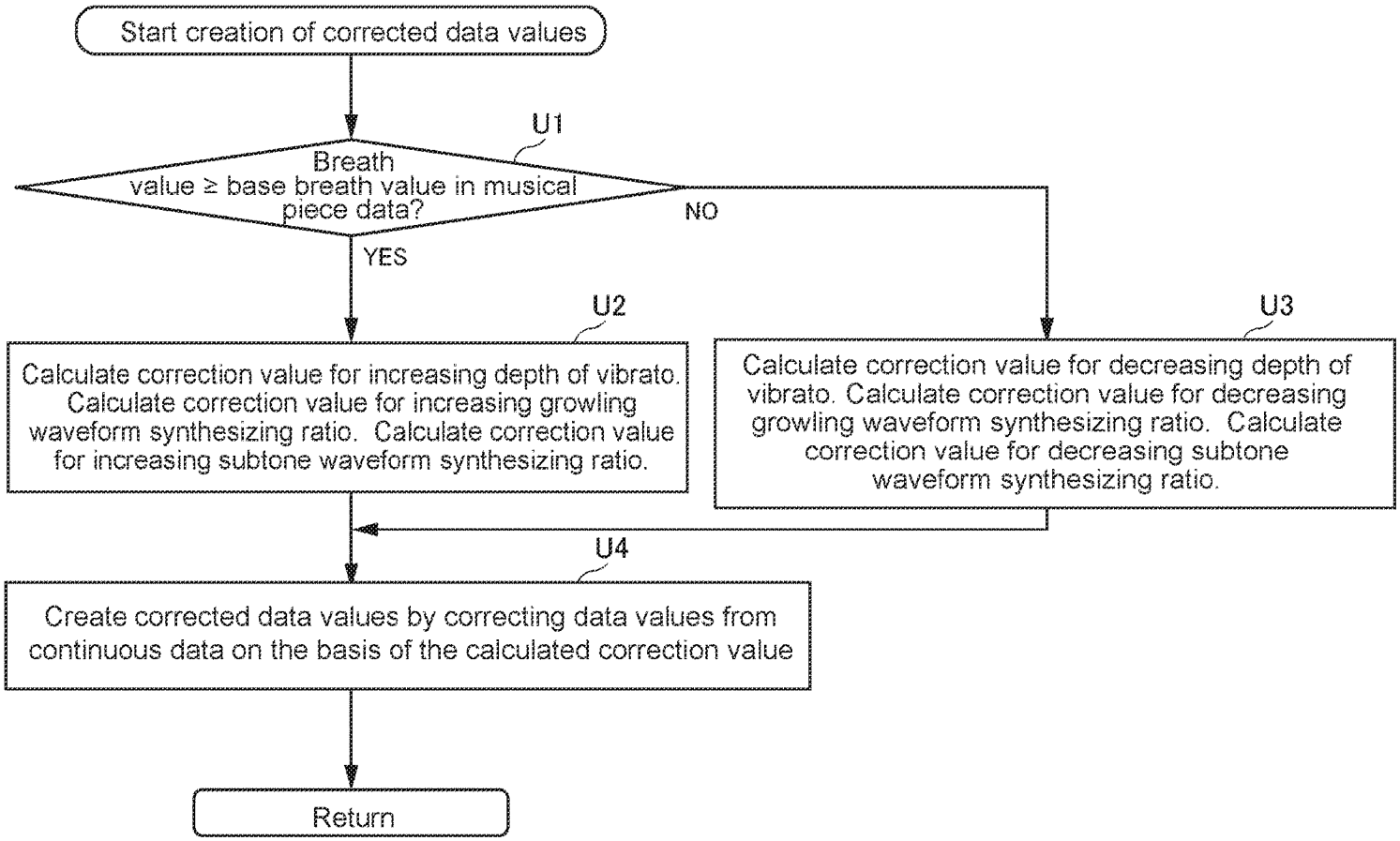
FIG. 7 is a flowchart of a process for creating corrected data values for data values in continuous data, which is a subroutine in FIG. 6.

More specifically, the process in the flowchart illustrated in FIG. 7 is executed.

In step U1, the CPU 5 determines whether the breath value obtained from the breath sensor 10 is greater than or equal to base breath value set in the musical piece data. If it is determined that the breath value is greater than or equal to the base breath value (YES in step U1), the CPU 5 proceeds to step U2, and if it is determined that the breath value is less than the base breath value (NO in step U1), the CPU 5 proceeds to step U3.

In step U2, if the performance data values (data values) in the continuous data from the musical piece data are data values corresponding to a vibrato effect, for example, the CPU 5 calculates correction values for increasing the depth of the vibrato with respect to the data values.

Moreover, if the data values are data values corresponding to a growling effect, the CPU 5 calculates correction values for increasing the growling waveform synthesizing ratios (synthesizing percentages).

Furthermore, if the data values are data values corresponding to a subtone effect, the CPU 5 calculates correction values for increasing the subtone waveform synthesizing ratios (synthesizing percentages).

More specifically, conversion tables or functions for calculating the correction values are stored in the ROM 6 or the like, and the CPU 5 uses these conversion tables or functions to obtain the correction values on the basis of the base breath values and the breath values.

For example, the CPU 5 uses the conversion tables or functions to obtain the correction values (which determine what degree of correction to apply to the data values in the continuous data from the musical piece data) on the basis of differences between the base breath values and the breath values or indicators of how many percent larger the breath values are relative to the base breath values (below, both differences and indicators such as percentages will be referred to simply as "differences").

In the present modification example, the conversion tables or functions for obtaining the correction values are configured so as to yield small correction values when the differences between the base breath values and the breath values are small and such that the correction values increase dramatically when the differences become greater than or equal to a prescribed magnitude.

In other words, the correction applied to the data values in the musical piece data is a non-linear correction based on the conversion tables or functions.

This is because if changes in vibrato, growling, and subtones increase linearly by approximately the same amount as increases in the differences between the base breath values and the breath values in regions in which the differences are not greater than or equal to the prescribed magnitude, the resulting musical notes sound unnatural. Therefore, when the differences between the base breath values and the breath values are small, the correction values are small.

In other words, the correction values are increased in accordance with increases in the differences between the base breath values and the breath values, but the slope of this increase is small.

Meanwhile, when the breath values are sufficiently large (that is, when the differences are greater than or equal to the prescribed magnitude), it is more natural for vibrato, growling, and subtones to be emitted much more explosively, and therefore when the differences become greater than or equal to the prescribed magnitude, the correction values increase dramatically.

In step U3, if the performance data values (data values) in the continuous data from the musical piece data are data values corresponding to a vibrato effect, for example, the CPU 5 calculates correction values for decreasing the depth of the vibrato.

Moreover, if the data values are data values corresponding to a growling effect, the CPU 5 calculates correction values for decreasing the growling waveform synthesizing ratios (synthesizing percentages).

Furthermore, if the data values are data values corresponding to a subtone effect, the CPU 5 calculates correction values for decreasing the subtone waveform synthesizing ratios (synthesizing percentages).

More specifically, in step U3 the CPU 5 also calculates correction values using conversion tables or functions for calculating correction values, similar to in step U2. This is because as described above for step U2, applying a non-linear correction prevents the resulting musical notes from sounding unnatural.

In step U4, the CPU 5 creates the corrected data values by applying corrections to the data values in the continuous data from the musical piece data on the basis of the correction values calculated in step U2 or step U3.

For vibrato, the data values corresponding to vibrato in the musical piece data (for example, data values for bending data or data values for modulation data) are corrected on the basis of the correction values.

In other words, when the breath value is greater than the base breath value, the CPU 5 obtains the corrected data value by applying a correction that increases the depth of vibrato to the data value corresponding to vibrato, and when the breath value is less than the base breath value, the CPU 5 obtains the corrected data value by applying a correction that decreases the depth of vibrato to the data value corresponding to vibrato.

Moreover, if the breath value is equal to the base breath value, the correction value is set such that the corrected data value becomes equal to the original data value corresponding to vibrato in the musical piece data.

For example, if the corrected data value is obtained by multiplying the correction values with the data value corresponding to vibrato in the musical piece data, the correction value is set to 1, and in the case where the correction value is added, the correction value is set to 0.

For growling, the data values corresponding to growling waveform synthesizing ratios (synthesizing percentages) in the musical piece data are corrected on the basis of the correction values.

In other words, when the breath value is greater than the base breath value, the CPU 5 obtains the corrected data value by applying a correction that increases the synthesizing ratios (synthesizing percentages) to the data value corresponding to the growling waveform synthesizing ratio (synthesizing percentage), and when the breath value is less than the base breath value, the CPU 5 obtains the corrected data value by applying a correction that decreases the synthesizing ratio (synthesizing percentage) to the data value corresponding to the growling waveform synthesizing ratio (synthesizing percentage).

Moreover, similar to for vibrato, if the breath value is equal to the base breath value, the correction value is set such that the corrected data value becomes equal to the original data value corresponding to the growling waveform synthesizing ratio (synthesizing percentage) in the musical piece data.

For subtones, the data values corresponding to subtone waveform synthesizing ratios (synthesizing percentages) in the musical piece data are corrected on the basis of the correction values.

In other words, when the breath value is greater than the base breath value, the CPU 5 obtains the corrected data value by applying a correction that increases the synthesizing ratio (synthesizing percentage) to the data value corresponding to the subtone waveform synthesizing ratio (synthesizing percentage), and when the breath value is less than the base breath value, the CPU 5 obtains the corrected data value by applying a correction that decreases the synthesizing ratio (synthesizing percentage) to the data value corresponding to the subtone waveform synthesizing ratio (synthesizing percentage).

Moreover, similar to for vibrato, if the breath value is equal to the base breath value, the correction value is set such that the corrected data value becomes equal to the original data value corresponding to the subtone waveform synthesizing ratio (synthesizing percentage) in the musical piece data.

Next, once the corrected data values are created in step U4 as described above, the process in the flowchart illustrated in FIG. 7 ends, and the CPU 5 returns to the process in the flowchart in FIG. 6.

In step MT3, the CPU 5 performs a control process of generating second sound waveform data based on the corrected data values and then outputting that second sound waveform data to the sound source 8 in order to make the sound emitter 2 emit that sound.

As described above, the CPU 5 executes the corrected data value obtaining process of obtaining corrected data values by applying a correction to the data values in the musical piece data (MIDI data) on the basis of base breath values set in the musical piece data (MIDI data) in advance and breath values obtained from the breath sensor 10, and also executes the sound emission process of making the sound emitter 2 emit sound on the basis of the corrected data values, thereby making it possible to provide a performance which more expressively reflects the breath input operations (breathing) of the performer.

Next, upon proceeding to step MT4, the CPU 5 determines whether the breath value obtained from the breath sensor 10 is greater than the threshold value. If the breath value is greater than the threshold value (YES in step MT4), the CPU 5 proceeds to step MT6 and determines whether the note-on timing of the next sound has occurred.

Then, if this note-on timing has not yet occurred (NO in step MT6), the CPU 5 returns to step MT2 and repeats the correction process in the same manner described above.

In other words, because the process of correcting the data values in the continuous data is repeated, the sound emitted so as to temporally change in a continuous manner is itself changed in accordance with the performer's breath input operations, thereby reflecting the performer's expressive ability.

Moreover, if step MT6 yields YES, the CPU 5 returns to the flowchart in FIG. 5 and performs the processes in steps T13 and on in order to process the next sound or the like.

Meanwhile, if step MT4 yields NO, the CPU 5 proceeds to step MT5 and performs a control process of outputting control data for silencing sound (note-off data) to the sound source 8 in order to silence sound being emitted by the sound emitter 2, and then returns to the process in the flowchart in FIG. 5.

In other words, sound is silenced because breath is no longer being input, and then the CPU 5 returns to the flowchart in FIG. 5 and performs the processes in steps T13 and on in order to process the next sound or the like so that the next time breath is input, the resulting sound is not unnatural.

As described above, in the modification example of the second mode, by performing the correction process of correcting the performance data values (the performance data values for effects such as vibrato, growling, and subtones in the continuous data) in the musical piece data and then generating the second sound waveform data on the basis of the corrected data values corrected by this correction process, a performance that more accurately reflects the state of the breathing is achieved, thereby making it possible to practice more expressive breathing techniques.

Moreover, a third mode may be configured in which the basic volume and the like are handled in the correction process on the basis of the base breath values in the musical piece data and the breath values obtained from the breath sensor 10, while for techniques for performing effects such as tremolo, growling, tonguing, vibrato, and subtones, third sound waveform data based on a plurality of performance data values included in the musical piece data for those effects is output regardless of whether those techniques are detected or are not detected.

In other words, this third mode may be configured such that performance elements other than those associated with techniques for performing effects such as tremolo, growling, tonguing, vibrato, and subtones are handled in the correction process on the basis of the base breath values and the breath values obtained from the breath sensor 10.

In this third mode, the third sound waveform data based on the performance data values included in the musical piece data does not necessarily have to be output for all of the abovementioned techniques, and the third sound waveform data based on the performance data values included in the musical piece data may be output for at least one or more of those abovementioned techniques.

In this case, the CPU 5 performs a control process of selectively switching between the comprehensive practice mode (first mode), the breathing practice mode (second mode), and this third mode in accordance with the performer's selection.

Note that although the descriptions above focused on modes that make it possible to practice breathing without worrying about fingering, beginners may also want to practice fingering (operation of the performance keys 1A) without worrying about the breathing, for example.

Therefore, such a performance key practice mode (fourth mode) for practicing operation of the performance keys 1A may be configured.

Figure 8:
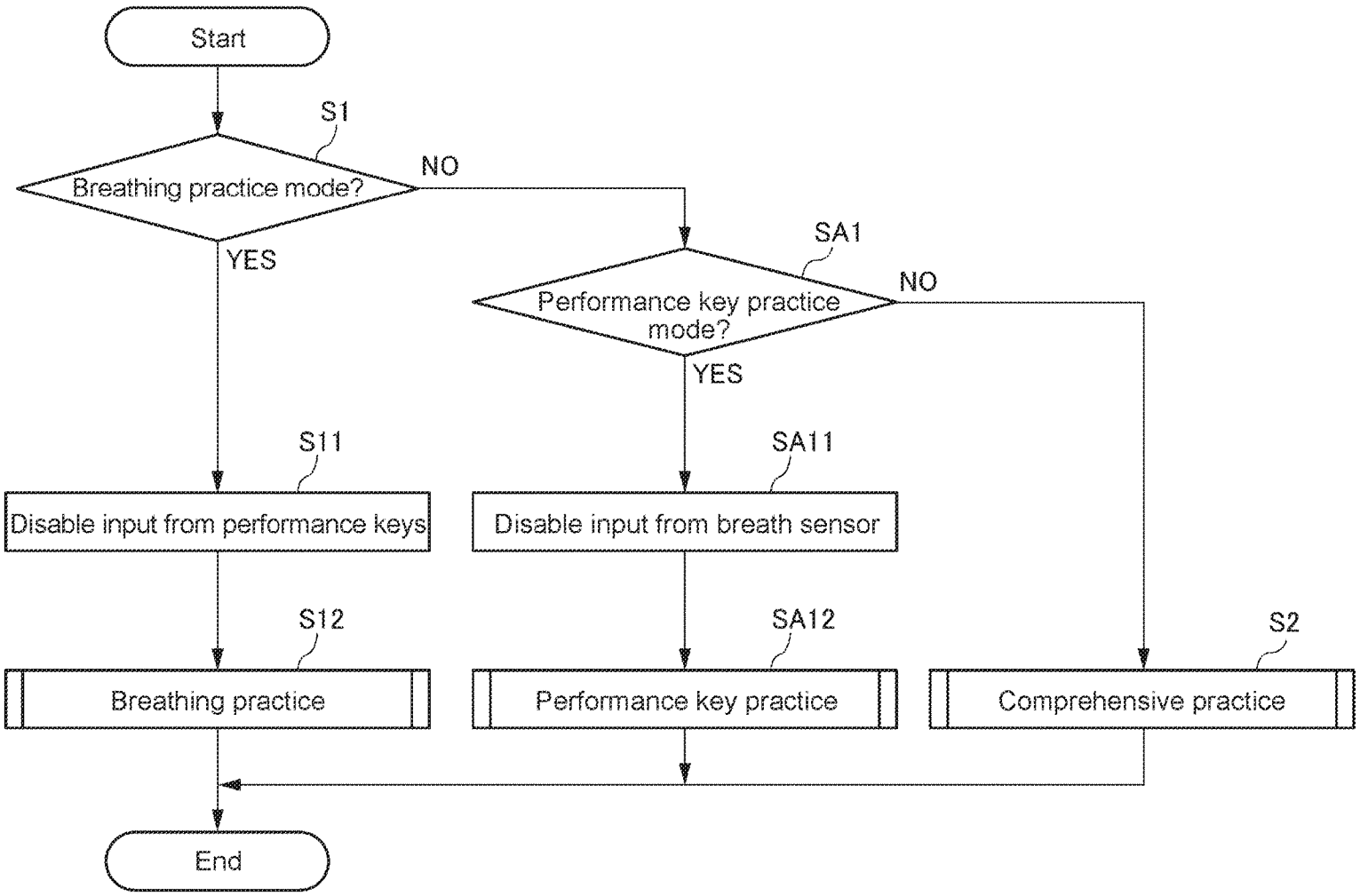
FIG. 8 is a flowchart illustrating a main routine of a practice mode process which also includes a performance key practice mode (fourth mode).

In this case, as illustrated in FIG. 8, in order to make it possible to execute the performance key practice mode (fourth mode) in accordance with the performer's selection, an additional step SA1 of determining whether the practice mode is the performance key practice mode (fourth mode) is added for when step S1 in the flowchart in FIG. 4 yields NO. Here, if it is determined that the performance key practice mode (fourth mode) was selected (YES in step SA1), the CPU 5 proceeds to step SA11 and disables input from the breath sensor 10, and then the CPU 5 proceeds to step SA12 and executes a process based on the performance key practice mode (fourth mode) flowchart illustrated in FIG. 9. Meanwhile, if it is determined that the performance key practice mode (fourth mode) was not selected (NO in step SA1), the CPU 5 proceeds to step S2 and executes the comprehensive practice mode.

Furthermore, in this case, the CPU 5 performs a control process of selectively switching between the comprehensive practice mode (first mode), the breathing practice mode (second mode), the third mode, and this performance key practice mode (fourth mode) in accordance with the performer's selection.

Figure 9:
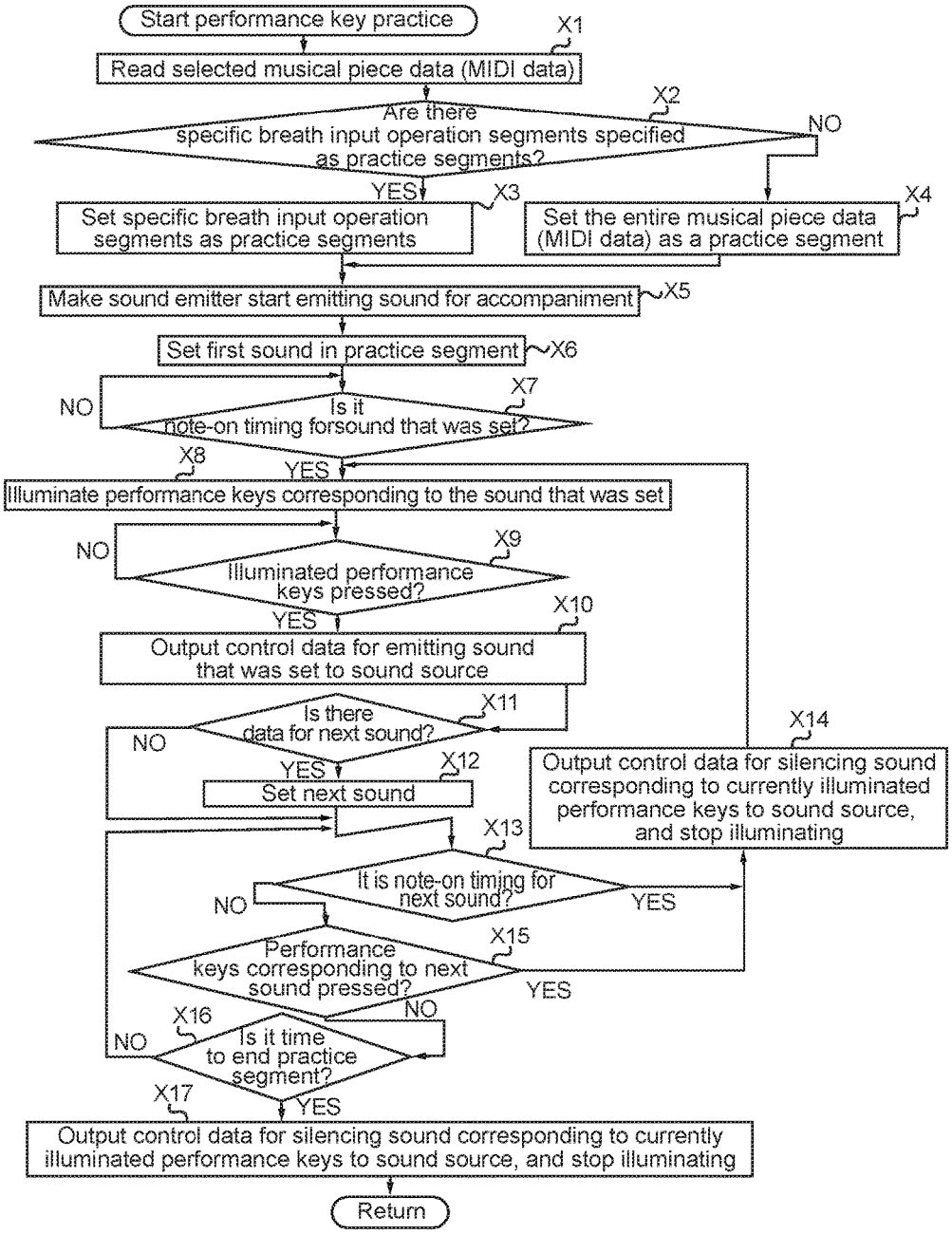
FIG. 9 is a flowchart of the performance key practice mode (fourth mode), which is a subroutine of the main routine illustrated in FIG. 8.

More specifically, although the performance key practice mode (fourth mode) will be described with reference to FIG. 9. Here, the CPU 5 outputs, to the sound source 8, control data for controlling emission and silencing of sounds from the sound emitter 2 on the basis of musical piece data (MIDI data), operation of the performance keys 1A, and the like regardless of the breath values obtained from the breath sensor 10, thereby controlling the sound emitter 2 so as to emit sounds, controlling the sound emitter 2 so as to silence sounds, and the like.

Although this will be described in more detail later, in the performance key practice mode (fourth mode), when the performance keys 1A are operated in accordance with a first musical note in the musical piece data, instead of outputting the expected output sound waveform data that should be generated and output on the basis of a breath input operation and operation of the performance keys 1A, the CPU 5 makes the sound source 8 generate a musical note signal (second sound waveform data) based on the first musical note in the musical piece data and makes the sound emitter 2 output a sound for that second sound waveform data, regardless of whether a breath input operation is detected or is not detected by the breath sensor 10.

Moreover, in the performance key practice mode (fourth mode), similar to in the comprehensive practice mode (first mode) described above, in order to provide a performance guide, the CPU 5 performs a control process of making the light source 9 illuminate the performance keys 1A that should be pressed by the performer at the timing at which those keys should be pressed and also makes the light source 9 stop illuminating the performance keys 1A at the timing at which those performance keys 1A should stop being pressed.

This allows the performer to focus on practicing operation of the performance keys 1A without having to perform breath input operations, for example.

In particular, because breath input operations are not required, rather than holding the mouthpiece 3 in the mouth in a state that makes it difficult to see the performance keys 1A, the performer can hold the electronic wind instrument 100 in an orientation that makes the performance keys 1A easy to see and then proceed to practice in the performance key practice mode (fourth mode).

Thus, the performance key practice mode (fourth mode) makes it possible to focus on practicing operation of the performance keys 1A without worrying about breath input operations, thereby making it possible to efficiently learn operation of the performance keys 1A.

Moreover, as described above, the data for making the main musical instrument play autonomously has markers (identifiers) corresponding to segments to be played with each breath (breath input operation segments), and therefore while practicing in the performance key practice mode (fourth mode), the performer can practice the breath input operation segments specified by the performer as practice segments rather than practicing the entire musical piece as a unit.

In other words, the performer can select and set arbitrary breath input operation segments of the musical piece data, thereby making it possible for the performer to practice breath input operation segments that he/she particularly wants to practice (such as two sequential breath input operation segments or a single breath input operation segment, for example) in a more focused manner.

As described above, in wind instruments, it is common for there to be a plurality of sequential musical notes within a segment played with a single breath (a breath input operation segment), and thus the performance keys 1A must be operated multiple times within that breath input operation segment.

Therefore, if there are three sequential musical notes within a single breath input operation segment, for example, the performance keys 1A must be operated three times, and when that breath input operation segment is set as a practice segment, this would configure a session of practicing the three sequential operations of the performance keys 1A corresponding to those three musical notes.

Next, the process for when the performance key practice mode (fourth mode) is selected will be described in detail with reference to FIG. 9.

Once the performance key practice mode (fourth mode) begins, in step X1, the CPU 5 executes a process of loading the musical piece data (MIDI data) selected by the performer from among the musical piece data stored in the ROM 6 into the RAM 7 (which functions as a working area), and then proceeds to step X2.

In step X2, the CPU 5 determines whether there are any specific breath input operation segments for the musical piece data that the performer has set as practice segments. If the CPU 5 determines in step X2 that there are specific breath input operation segments for the musical piece data that have been specified by the performer (YES in step X2), the CPU 5 proceeds to step X3 and sets, as practice segments, only the specific breath input operation segments specified by the performer from among the breath input operation segments in the musical piece data (MIDI data).

Moreover, if there are a plurality of specific breath input operation segments, all of those breath input operation segments are joined together and set as a single practice segment.

Meanwhile, if the CPU 5 determines in step X2 that there are no specific breath input operation segments for the musical piece data that were specified by the performer (NO in step X2), the CPU 5 proceeds to step X4 and sets the first to last segments of the musical piece data (that is, the entire musical piece) as a practice segment.

Here, the musical note signals based on the one or more musical notes in the musical piece data for the practice segment that was set are the second sound waveform data.

Upon completing the process in step X3 or step X4, the CPU 5 proceeds to step X5 and makes the sound emitter 2 start emitting sound for an accompaniment (a part played by a musical instrument other than the main musical instrument) on the basis of the musical piece data.

More specifically, in accordance with musical piece data, the CPU 5 sequentially outputs control data such as note data (note-on data, note-off data, and the like) and continuous data corresponding to the accompaniment to the sound source 8 and thus makes the sound source 8 generate musical note signals (sound waveform data for the accompaniment) and send those musical note signals to the sound emitter 2, which causes the sound emitter 2 to emit sounds corresponding to those musical note signals.

Moreover, although a description of the accompaniment portion will be omitted below, in the present embodiment, when the performance of the main musical instrument stops due to the performer having stopped operating the performance keys 1A midway, for example, the automatically played accompaniment is also controlled to be a stopped state, and then the automatically played accompaniment is resumed from that point once operation of the performance keys 1A is resumed.

Once the accompaniment begins being emitted (step X5), the CPU 5 proceeds to step X6 and performs a process of setting the first sound (the first musical note in the musical piece data) in the practice segment, and then the CPU 5 proceeds to step X7 and monitors for a note-on (emission) timing of the sound that was set.

In other words, the CPU 5 continuously determines whether the note-on (emission) timing of the sound set in step X7 has occurred, and, upon determining that the note-on (emission) timing has occurred (YES in step X7), proceeds to step X8.

Upon proceeding to step X8, the CPU 5 executes an identifier output process of outputting, to the light source 9, identifiers which identify the performance keys 1A corresponding to the sound that was set (the first musical note in the musical piece data). This causes the light source 9 to illuminate the performance keys 1A corresponding to those identifiers so as to provide a guide as to which performance keys 1A among the plurality of performance keys 1A are the performance keys 1A that the performer should press.

Next, the CPU 5 proceeds to step X9 and determines whether the illuminated performance keys 1A are being pressed.

Then, once it is determined that the illuminated performance keys 1A are being pressed (YES in step X9), the CPU 5 proceeds to step X10 and performs a control process of outputting control data (note-on data, continuous data) for emitting the sound set in step X6 (the first musical note in the musical piece data) to the sound source 8 in order to make the sound emitter 2 emit that sound.

Thus, if the performance keys 1A corresponding to the sound set in step X6 (the first musical note in the musical piece data) are not pressed, the CPU 5 does not proceed from step X9 to step X10. Therefore, if the performance keys 1A corresponding to the first musical note in the musical piece are not successfully pressed, even if the performance keys 1A corresponding to a second musical note which follows the first musical note are pressed next, the sound emitter 2 will not output the sound for the next set of second sound waveform data corresponding to that second musical note in the musical piece data.

Once the process in step X10 is complete, the CPU 5 proceeds to step X11 and determines whether there is data for a next sound (the second musical note) in the practice segment.

If the CPU 5 determines in step X11 that there is data for a next sound (the second musical note) (YES in step X11), the CPU 5 proceeds to step X12, executes a process of setting the next sound (the second musical note) in the practice segment, and then proceeds to step X13.

Meanwhile, if it is determined in step X11 that there is not any data for a next sound (NO in step X11), the CPU 5 proceeds to step X13 without performing the process of step X12.

Upon proceeding to step X13, the CPU 5 determines whether the note-on (emission) timing of the next sound that was set has occurred. If it is determined that the note-on (emission) timing of the next sound has occurred (YES in step X13), the CPU 5 proceeds to step X14 and performs a control process of outputting control data (note-off data) for silencing the sound corresponding to the currently illuminated performance keys 1A to the sound source 8 in order to silence emission of sound from the sound emitter 2, as well as making the light source 9 stop illuminating the currently illuminated performance keys 1A. Then, the CPU 5 returns to step X8 and, as described above, performs the control process of making the light source 9 illuminate the performance keys 1A corresponding to the next sound that was set (the second musical note).

In this manner, the CPU 5, on the basis of the musical piece data, continues performing the control process of making the light source 9 illuminate the performance keys 1A that should be pressed from among the performance keys 1A as well as the control process of making the sound emitter 2 emit sound on the basis of the musical piece data and operation of the performance keys 1A regardless of whether breath input operations are detected or are not detected by the breath sensor 10.

Meanwhile, if it is determined in step X13 that the note-on (emission) timing of the next sound (the second musical note) has not yet occurred (NO in step X13), the CPU 5 proceeds to step X15 and determines whether the performance keys 1A corresponding to the next sound (the second musical note) have been pressed.

Once the performer improves to the point of memorizing the order of the performance keys 1A, for example, there may be cases in which the performer presses the next performance keys 1A slightly before the note-on (emission) timing of the next sound (the second musical note).

In such cases, in order to avoid creating an unnatural feeling for the performer, it is preferable that the next sound (the second musical note) be emitted. Therefore, if it is determined in step X15 that the performance keys 1A corresponding to the next sound (the second musical note) have been pressed (YES in step X15), the CPU 5 proceeds to step X14 and, as described above, performs the process of silencing the current sound and then returns to step X8 and performs the control process of illuminating the performance keys 1A corresponding to the next sound (the second musical note).

Then, because the performance keys 1A corresponding to the illuminated performance keys 1A have already been pressed, the determination in the following step X9 also yields YES, and the CPU 5 proceeds to step X10 and quickly makes the next sound (the second musical note) be emitted.

In other words, when the performance keys 1A corresponding to the sound set in step X6 (the first musical note in the musical piece data) are pressed and the sound emitter 2 starts emitting sound, even if the performance keys 1A corresponding to the second musical note (which is next sound following the first musical note) are then pressed before the correct timing of the operation of the performance keys 1A corresponding to the second musical in the musical piece data, the CPU 5 still performs the control process of outputting the control data (note-on data, continuous data) for emitting the second musical note in the musical piece data to the sound source 8 in order to make the sound emitter 2 output (emit) that sound (the sound for the next set of second sound waveform data, which corresponds to the second musical note).

Moreover, in the present embodiment, even when the performance keys 1A are pressed before the correct timing of the next operation of the performance keys 1A, if the determination results do not match the performance keys 1A that should have been pressed next (NO in step X15), the CPU 5 does not proceed to step X14, and therefore the sound emitter 2 continues emitting the current sound, thereby preventing an incorrect sound from being emitted.

Meanwhile, if the CPU 5 determines in step X15 that the performance keys 1A corresponding to the next sound have not been pressed (NO in step X15), the CPU 5 proceeds to step X16 and determines whether the timing of the end of the practice segment has occurred.

Then, if it is determined in step X16 that the timing of the end of the practice segment has not yet occurred (NO in step X16), the CPU 5 returns to step X13 and performs the same process described above again. Meanwhile, if it is determined in step X16 that the timing of the end of the practice segment has occurred (YES in step X16), the CPU 5 proceeds to step X17 and performs the control process of outputting control data (note-off data) for silencing the sound corresponding to the currently illuminated performance keys 1A to the sound source 8 in order to silence emission of sound from the sound emitter 2, as well as making the light source 9 stop illuminating the performance keys 1A.

Waiting until the performer stops pressing the performance keys 1A to output the control data (note-off data) for silencing sound to the sound source 8 makes it possible to end the performance in a way that is natural. Therefore, it is preferable that in step X17, the CPU 5 wait until the end of the operation of the performance keys 1A is detected to output the control data (note-off data) for silencing sound to the sound source 8.

When the CPU 5 waits in this manner until the end of the operation of the performance keys 1A is detected to output the control data (note-off data) for silencing sound to the sound source 8, the CPU 5 outputs loop process data to the sound source 8 when the determination in step X16 yields YES so that the sound emitter 2 can continue emitting sound on the basis of this loop process data during the period from when the determination in step X16 yields YES until when the end of the operation of the performance keys 1A is actually detected.

For example, data from a range of approximately 10% of the continuous data for the sound prior to the end position of the practice segment should be set as the loop process data.

However, if the sound immediately prior to the end position of the practice segment is a vibrato sound, it is preferable that the sound waveform data based on the loop process data have approximately the same level of vibrato effect applied thereto for the entire looped segment, for example, so that the sound emitter 2 continues to output sound waveform data having a vibrato effect applied thereto.

Next, once the process in step X17 is complete, the CPU 5 returns to the main routine illustrated in FIG. 8 and then ends the overall process.

The present invention is not limited to the embodiments described above, and various modifications may be made in the implementation of the present invention without departing from the spirit thereof. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention. Moreover, the functionality achieved in the embodiments described above may be combined as appropriate in additional implementations. The embodiments described above include various aspects, and various inventions may be implemented in the form of appropriate combinations of the constituent features disclosed herein. For example, even if several constituent features among all of the constituent features in the embodiments as described above are removed, any resulting configuration in which constituent features have been removed may still be regarded to be within the scope of the present invention as long as the effects of the invention are still achieved.

What is claimed is:

1. An electronic wind instrument, comprising:

a plurality of performance keys for respectively specifying pitches;

a breath sensor that detects a breath input operation by a user;

a memory storing therein musical piece data of a musical piece, the musical piece data including a part to be played by the electronic wind instrument; and a processor, wherein the processor defines user-selectable at least two modes of operation, which are a normal mode and a practice mode, wherein in the normal mode, the processor generates sound waveform data in accordance with both of the breath input operation and operations of the plurality of performance keys by the user, and causes the generated sound waveform date to output audibly to the user, and wherein in the practice mode, the processor performs the following:

receiving instructions from the user to select the musical piece to be practiced;

reading out at least a portion of the musical piece data representing at least a pitch of a note to be played by the electronic wind instrument in the selected musical piece from the memory;

generating sound waveform data, even if there is no operation of the performance keys by the user, in accordance with the breath input operation by the user and said read out portion of the musical piece data representing at least the pitch of the note; and causing the generated sound waveform data to output audibly to the user so that the user can practice the breath input operation for the musical piece even if there is no operation of the performance keys by the user, wherein the breath sensor outputs a breath value representing a pressure of a breath applied by the user, and the processor determines a degree of the breath input operation performed by the user based on the breath value, and wherein in the practice mode, said portion of the musical piece data further includes data representing a sound effect to be applied to the note to be played and a base breath value associated with the sound effect, and the processor determines a degree of the sound effect to be applied to the note based on a difference between the base breath value and the breath value output by the breath sensor, and applies the determined degree of the sound effect to the note to be played in generating the sound waveform data.

2. The electronic wind instrument according to claim 1, wherein for at least some of notes on the musical piece data, said sound effect is vibrato, and when the portion of the musical piece data read out by the processor includes data representing the vibrato to be applied to the note, the processor increases a depth of the vibrato to be applied to the note from a default value included in the read out portion of the musical piece data when the breath value is greater than the base breath value, and decreases the depth of vibrato to be applied to the note from the default value included in the read out portion of the musical piece data when the breath value is less than the base breath value, in generating the sound waveform data.

3. The electronic wind instrument according to claim 1, wherein for at least some of notes on the musical piece data, said sound effect is a growling technique, and when the portion of the musical piece data read out by the processor includes data representing the growling technique to be applied to the note, the processor increases a growling waveform synthesizing ratio from a default value included in the read out portion of the musical piece data when the breath value is greater than the base breath value, and decreases the growling waveform synthesizing ratio from the default value included in the read out portion of the musical piece data when the breath value is less than the base breath value, in generating the sound waveform data.

4. The electronic wind instrument according to claim 1, wherein for at least some of notes on the musical piece data, said sound effect is a subtone technique, and when the portion of the musical piece data read out by the processor includes data representing the subtone technique to be applied to the note, the processor increases a subtone waveform synthesizing ratio from a default value included in the read out portion of the musical piece data when the breath value is greater than the base breath value, and decreases the subtone waveform synthesizing ratio from the default value included in the read out portion of the musical piece data when the breath value is less than the base breath value, in generating the sound waveform data.

5. The electronic wind instrument according to claim 1, wherein the musical piece data includes identifiers that define a breath input operation segment that includes a plurality of successive series of notes to be played and a plurality of breathing on and off operations to be performed by the user, and wherein when the practice mode is executed in the breath input operation segment of the musical piece data, the processor generates sound waveform data such that the successive series of notes included in the breath input operation segment are output in synchronization with the plurality of breathing on and off operations that are actually performed by the user so as to reflect timings of the breathing on and off operations that are actually performed by the user.

6. The electronic wind instrument according to claim 5, wherein while the practice mode is selected, if another breath input operation is detected after the breath input operation segment has ended, the processor generates sound waveform data based on the musical piece data from an end position of the breath input operation segment so as to cause the generated sound waveform data to output after the breath input operation segment has ended.

7. The electronic wind instrument according to claim 1, wherein in the practice mode, said portion of the musical piece data further includes data representing a sound effect to be applied to the note to be played and a base breath value for modifying a volume of the note to be played, and the processor modifies the volume of the note based on a difference between the base breath value and the breath value output by the breath sensor, and applies the sound effect represented by said data included in said portion of the musical data to the note in generating the sound waveform data.

8. The electronic wind instrument according to claim 1, wherein the processor defines another user-selectable mode, which is a key operation practice mode, and wherein in the key operation practice mode, the processor performs the following:

receiving instructions from the user to select the musical piece to be practiced;

reading out at least a portion of the musical piece data representing at least the breath input operations to be performed by the user in the selected musical piece from the memory;

ignoring any breath input operation actually performed by the user;

generating sound waveform data in accordance with said portion of the musical piece data representing at least the breath input operations and operations of the plurality of performance keys actually performed by the user; and causing the generated sound waveform data to output audibly to the user so that the user can practice the operations of the performance keys for the musical piece without the breath input operation by the user.

9. The electronic wind instrument according to claim 8, wherein while the key practice mode is selected, the processor causes the performance keys that should be operated by the user to be indicated to the user in accordance with said read-out portion of the musical piece data so as to assist the user practice.

10. A method performed by a processor in a practice mode of an electronic wind instrument that includes a plurality of performance keys for respectively specifying pitches; a breath sensor that detects a breath input operation by a user; a memory storing therein musical piece data of a musical piece, the musical piece data including a part to be played by the electronic wind instrument; and said processor, wherein the processor defines user-selectable at least two modes of operation, which are a normal mode and said practice mode, wherein in the normal mode, the processor generates sound waveform data in accordance with both of the breath input operation and operations of the plurality of performance keys by the user, and causes the generated sound waveform date to output audibly to the user, and wherein in the practice mode, the method performed by the processor comprises:

receiving instructions from the user to select the musical piece to be practiced;

reading out at least a portion of the musical piece data representing at least a pitch of a note to be played by the electronic wind instrument in the selected musical piece from the memory;

generating sound waveform data, even if there is no operation of the performance keys by the user, in accordance with the breath input operation by the user and said read out portion of the musical piece data representing at least the pitch of the note; and causing the generated sound waveform data to output audibly to the user so that the user can practice the breath input operation for the musical piece even if there is no operation of the performance keys by the user, wherein the breath sensor outputs a breath value representing a pressure of a breath applied by the user, and the processor determines a degree of the breath input operation performed by the user based on the breath value, and wherein in the practice mode, said portion of the musical piece data further includes data representing a sound effect to be applied to the note to be played and a base breath value associated with the sound effect, and the processor determines a degree of the sound effect to be applied to the note based on a difference between the base breath value and the breath value output by the breath sensor, and applies the determined degree of the sound effect to the note to be played in generating the sound waveform data.

11. A non-transitory computer-readable storage medium having stored thereon a program executable by a processor in a practice mode of an electronic wind instrument that includes a plurality of performance keys for respectively specifying pitches; a breath sensor that detects a breath input operation by a user; a memory storing therein musical piece data of a musical piece, the musical piece data including a part to be played by the electronic wind instrument; and said processor, wherein the program causes the processor to define user-selectable at least two modes of operation, which are a normal mode and said practice mode, wherein in the normal mode, the program causes the processor to generate sound waveform data in accordance with both of the breath input operation and operations of the plurality of performance keys by the user, and cause the generated sound waveform date to output audibly to the user, and wherein in the practice mode, the program causes the processor to perform the following:

receiving instructions from the user to select the musical piece to be practiced;

reading out at least a portion of the musical piece data representing at least a pitch of a note to be played by the electronic wind instrument in the selected musical piece from the memory;

generating sound waveform data, even if there is no operation of the performance keys by the user, in accordance with the breath input operation by the user and said read out portion of the musical piece data representing at least the pitch of the note; and causing the generated sound waveform data to output audibly to the user so that the user can practice the breath input operation for the musical piece even if there is no operation of the performance keys by the user, wherein the breath sensor outputs a breath value representing a pressure of a breath applied by the user, and the processor determines a degree of the breath input operation performed by the user based on the breath value, and wherein in the practice mode, said portion of the musical piece data further includes data representing a sound effect to be applied to the note to be played and a base breath value associated with the sound effect, and the program causes the processor to determine a degree of the sound effect to be applied to the note based on a difference between the base breath value and the breath value output by the breath sensor, and apply the determined degree of the sound effect to the note to be played in generating the sound waveform data.

12. An electronic wind instrument, comprising:

a plurality of performance keys for respectively specifying pitches;

a breath sensor that detects a breath input operation by a user;

a memory storing therein musical piece data of a musical piece, the musical piece data including a part to be played by the electronic wind instrument; and a processor, wherein the processor defines user-selectable at least two modes of operation, which are a normal mode and a practice mode, wherein in the normal mode, the processor generates sound waveform data in accordance with both of the breath input operation and operations of the plurality of performance keys by the user, and causes the generated sound waveform date to output audibly to the user, and wherein in the practice mode, the processor performs the following:

receiving instructions from the user to select the musical piece to be practiced;

reading out at least a portion of the musical piece data representing at least a breath value to be played by the electronic wind instrument in the selected musical piece from the memory;

generating sound waveform data, even if there is no breath input operation by the user, in accordance with the operation of the performance keys by the user and said read out portion of the musical piece data representing at least the breath value; and causing the generated sound waveform data to output audibly to the user so that the user can practice the operation of the performance keys for the musical piece even if there is no breath input operation by the user.

* * * * *